US006457583B1

(12) United States Patent
Tee et al.

(10) Patent No.: US 6,457,583 B1
(45) Date of Patent: Oct. 1, 2002

(54) HOLDER DEVICE FOR TOOTHBRUSHES, TABLE KNIVES, FORKS AND SPOONS AND THE LIKE

(75) Inventors: Goo Yock Tee, Jobor; Tang Peng Kee, Selongor, both of (MY)

(73) Assignee: Orca Innovation SDN, BHD., Kuala Lumpur (MY)

( * ) Notice: Subject to any disclaimer, the term of this patent is extended or adjusted under 35 U.S.C. 154(b) by 0 days.

(21) Appl. No.: 09/667,676

(22) Filed: Sep. 22, 2000

(30) Foreign Application Priority Data

Sep. 22, 1999 (MY) ..... PI 9904104

(51) Int. Cl.[7] ..... B65D 83/10

(52) U.S. Cl. ..... 206/362.1; 206/361; 206/209.1; 132/308; 132/312

(58) Field of Search ..... 206/362.1, 361, 206/362, 362.2, 362.3, 362.4, 15.2, 15.3, 209.1; 132/308–310, 313, 290

(56) References Cited

U.S. PATENT DOCUMENTS 3,120,019 A * 2/1964 Scott ..... 15/184
3,127,985 A * 4/1964 Scott ..... 206/362.3
3,746,162 A * 7/1973 Bridges ..... 206/361
5,465,453 A * 11/1995 Landmeier ..... 15/247
5,779,046 A * 7/1998 Plakos ..... 206/362.3
5,924,567 A * 7/1999 Wenum ..... 206/362.3
5,960,801 A * 10/1999 Vermooten et al. ..... 132/308
6,129,090 A * 10/2000 Pillar et al. ..... 132/309

* cited by examiner

*Primary Examiner*—Mickey Yu
*Assistant Examiner*—Jila M. Mohandesi
(74) *Attorney, Agent, or Firm*—Lowe Hauptman Gilman & Berner, LLP

(57) ABSTRACT

A holder device for holding a head portion of a hand holdable elongate member comprises a mounting bracket (20) with a base (36) and two side walls (38) and a pair of side flaps (14,16) partially rotatable about a common axis. The flaps (14, 16) when in a closed position form an enclosed chamber with an aperture (32) at one end to accommodate the elongate member. The side flaps (14, 16) are pivotably mounted onto the mounting bracket (20). When force is applied onto bases (30) of the side flaps (14,16), the side flaps (14,16) will be triggered to close or open.

13 Claims, 7 Drawing Sheets

HOLDER DEVICE FOR TOOTHBRUSHES, TABLE KNIVES, FORKS AND SPOONS AND THE LIKE

The present invention relates to a holder device for toothbrushes, table knives, forks and spoons and the like. In particular the present invention relates to a holder device for holding and protecting portion of an elongate members such as toothbrush, forks, knives and spoons. More particularly the invention relates to a holder device to protect a portion of an elongate member such as toothbrushes, forks and knives ad spoons, from being exposed to insects such as houseflies and other pests.

It is common to find toothbrushes, knives, spoons and forks left exposed on trays, shelf, drawers, etc. after use. Toothbrushes in particular are often left exposed on top of shelves in the bathroom or are suspended from slots in trays in the bathroom. Similarly knives, spoons, forks etc. are stored in trays, on specially designed shelves with slots. Such utensils are exposed to household pests such as insect, like cockroaches. Cockroaches do crawl over brushes, knives, forks and spoons especially at night, thus soiling the utensils. Thus it is an object of the invention to provide a container for elongate domestic utensils such as toothbrushes, knives, forks and spoons.

Is another object of the present invention to provide a container for toothbrushes which encapsulates the brush portion of the toothbrushes, whilst exposing the handle portion of the toothbrushes.

SUMMARY OF THE INVENTION

A holder device for holding encapsulating a portion of a hand holdable elongate member comprising of a mounting bracket with a base and two side walls and a pair of side flaps partially rotatable about a common axis. The said flaps when in a closed position forms an enclosed chamber with an aperture at one end to accommodate the elongate member. The side flaps are mountable onto the mounting bracket. The edge of the side walls pivotable about the bottom portion of the side flaps. To close the side flaps from an open position, force is applied onto the base of the side flaps from the elongate member or force is applied on either one or both the side flaps in the direction perpendicular to the common axis. To open the side flaps firm a closed position the side flaps are partially rotated by the removal of the elongate member away from the common axis. In other words when force. is applied onto the base of the side flaps, it will automatically trigger the side flaps to close or open.

The base of each of the side flaps includes at least two jaws. The jaws allow partial rotation of the side flaps when the side flaps are assembled together but prevents the side flaps from being displaced along the common axis. The jaws are disposed below the base of the side flap and extends in a substantially horizontal direction perpendicular to the common axis. The side flaps includes an intermediate wall. The base on the outside includes a rib pivotable about the mounting bracket.

Each of the side flap include a cut-away portion so that when the side flaps are in a closed position, an aperture is formed. The holdable elongate member is selected from a tooth brush, table forks, table spoons, table knives, kitchen scissors an the like.

DETAILED DESCRIPTION OF THE INVENTION

The invention will know be described in detail by way of reference to a preferred embodiment of the invention and with reference to the following drawings in which.

Figure 1:
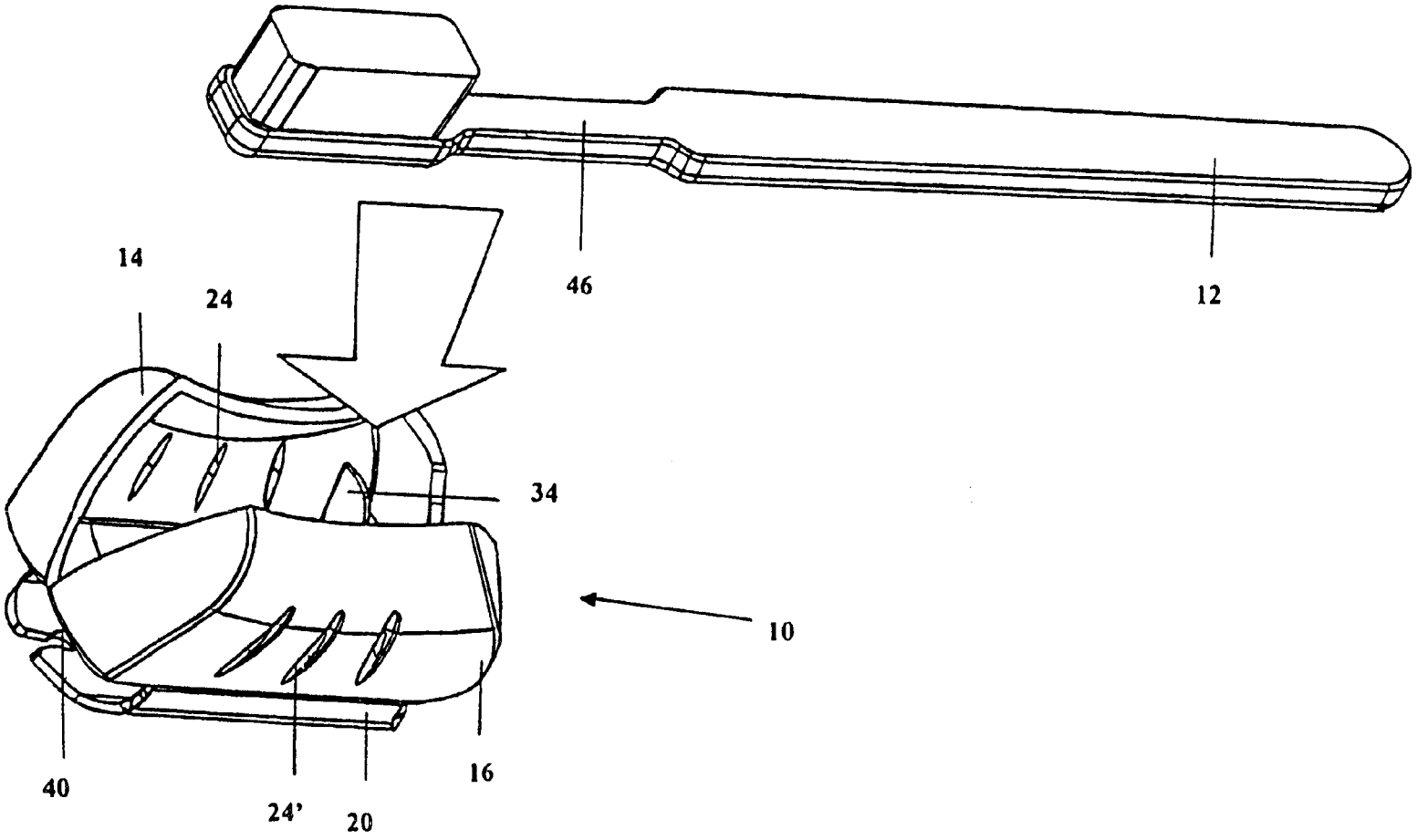
FIG. 1 illustrates a perspective view of a holder device in a open position with the toothbrush.

Referring now to FIGS. 1, 2, 3 and 4, there is illustrated a holder device (10) for a tooth brush (12). In one aspect, the holder device (10) consists of two separable side flaps (14, 16), a plurality of jaws (44) and a mounting bracket (20).

Figure 5:
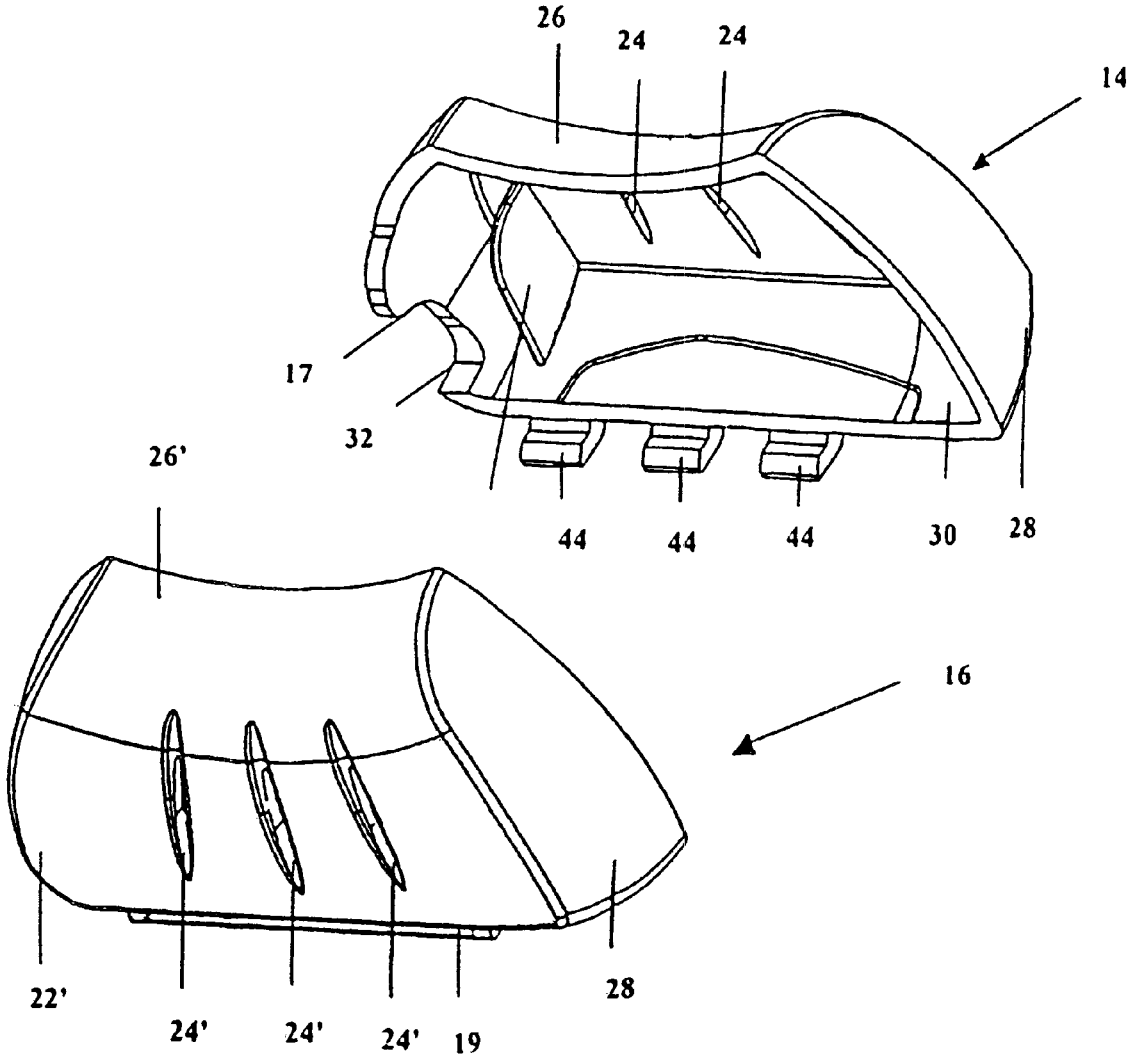
FIG. 5 is an exploded view of the features on the side flaps.

Each side flap (14,16) is substantially a mirror image of the other, (FIG. 5). The side flap identified by the numerical (14),will be described in detail, the features of the side flaps identified by numerical (16) corresponds and will be denoted by an (') to the numerical used of the side flap (14). The side flap (14) is four sided and the sides are integrally connected (FIG. 5). The lateral side plate (22,22') of the side flap includes a plurality of small apertures (24,24') to facilitate ventilation of the interior of the holder device (10) when in use.

Figure 2:
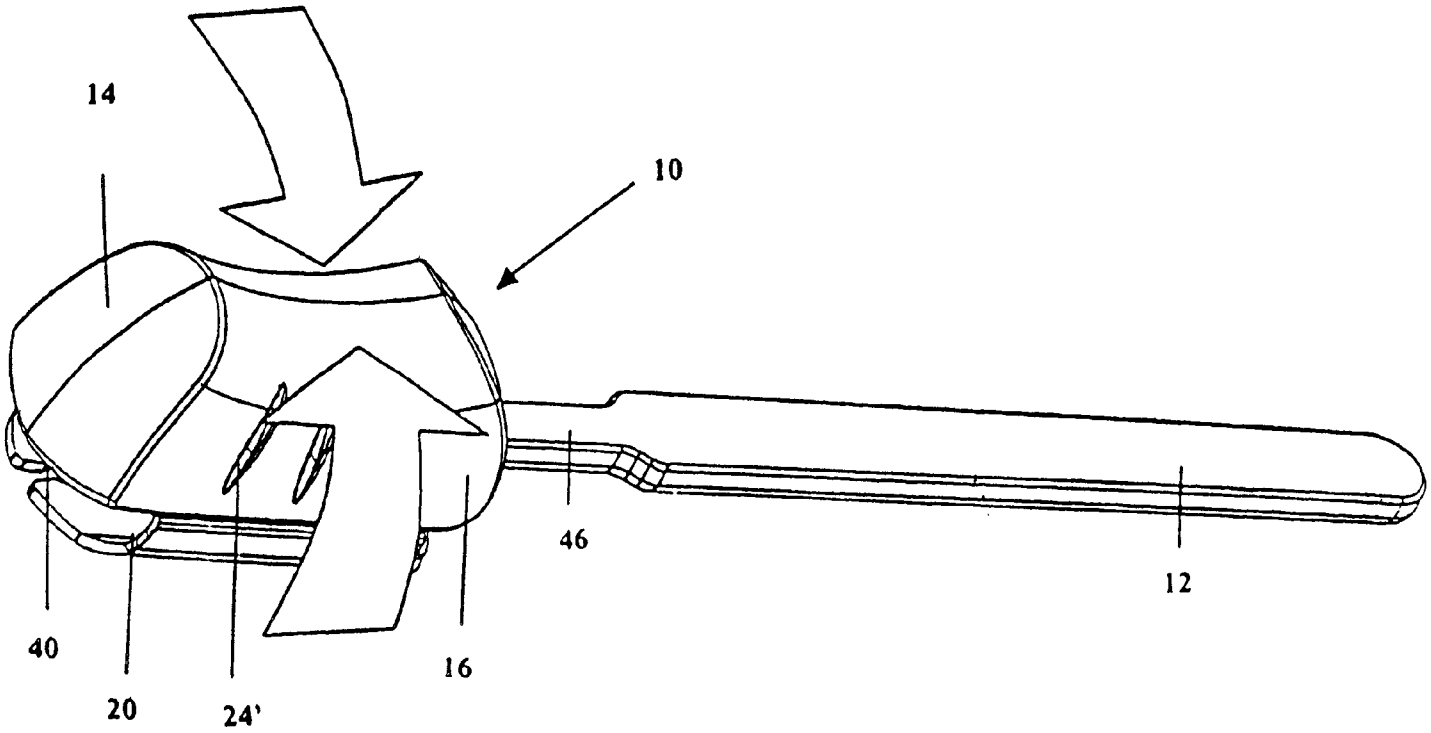
FIG. 2 illustrates a perspective view of a holder device shown in FIG. 1 in a closed position with the brush portion of the toothbrush housed thereon.

The upper plate (26,26'), front plate (28,28') and base plate (30,30') are integral with lateral side plate (22,22') and are dimensioned and configured to form a completely enclosed conical shape when the side flaps (14,16) are in a closed position, (FIG. 2). The base plate (30,30') of the side flap (14,16) includes a cut-away (32,32') to accommodate a handle of the toothbrush (12) and a frictional point surface (17) to enable opening of the side flaps (14,16), (FIG. 5).

The size of the cut-away (32,32') is such as to accommodate the portion of the handle of the toothbrush. An intermediate wall (34,34') is provided and positioned in each side flap (14,16) in a manner that when both the side flaps are in a closed portion, the intermediate walls (34,34') are immediately adjacent to each other.

Figure 6:
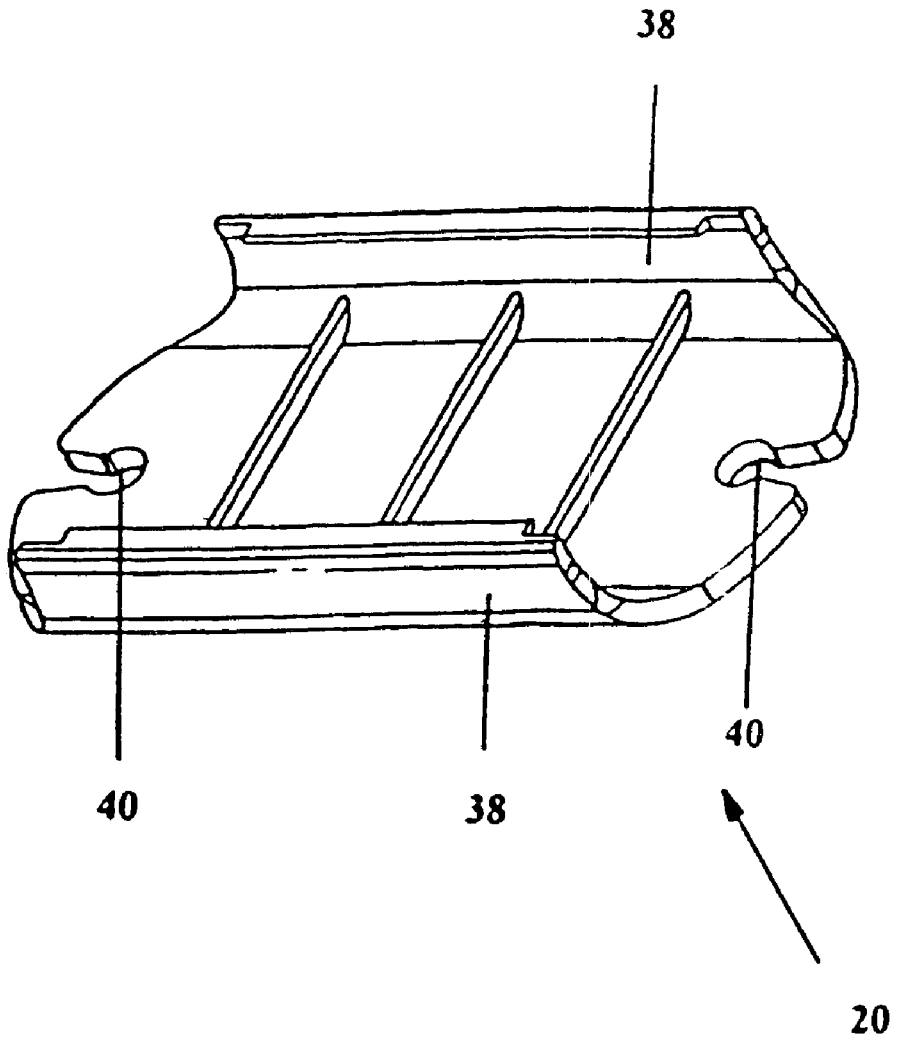
FIG. 6 is an exploded view of the features on the mounting bracket.

The mounting bracket (20) includes a base (36) and a two side walls (38), (FIG. 6). The edge of the side walls (38) of the mounting bracket (20) is pivotable about the bottom portion of the side flaps (14, 16). The base (36) includes two slot (40) at the terminal end of the mounting bracket (20) where a mounting means (not shown) is attached.

The base plate (30) of each of the side flaps (14,16) includes a plurality of jaws (44), (FIG. 5). The function of the jaws (44) is to allow partial rotation of the side flaps (14,16), when the side flaps (14,16) are assembled together but prevents the side flaps (14,16) from being displaced along the common axis. The jaws (44) are disposed below the base plate (30) of the side flap (14,16) and extends in a substantially horizontal direction perpendicular to the common axis, (FIG. 5).

The working of the holder device (10) and other features of the holder device (10) not described earlier will be described now. The holder device (10) is secured to a vertical surface by any suitable means. The back surface of the base plate (30) can be pivoted or glued to a receiving surface. Alternatively the back surface of the base plate (30)

can be secured to a receiving surface by screw or nails means (not illustrated). If the holder device (10) is closed without the toothbrush housed therein, the side flaps (14,16) are pulled open by both hands.

Figure 7:
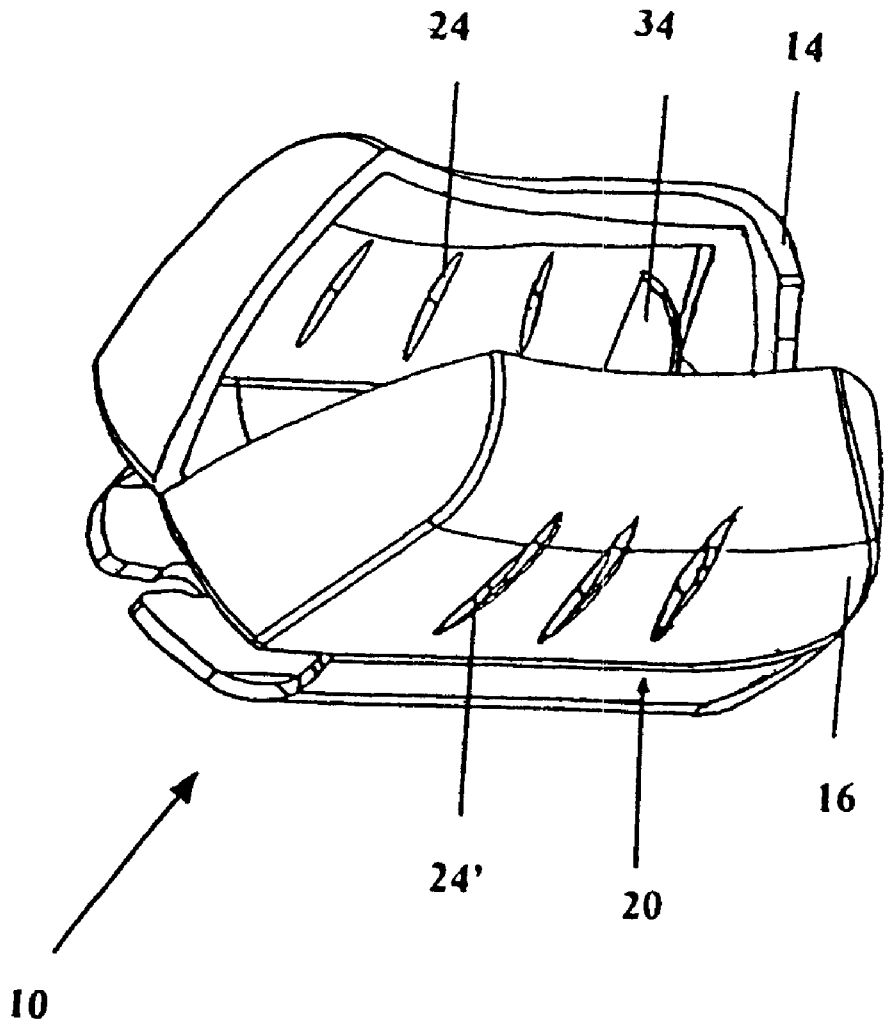
FIG. 7 illustrates a perspective view of a holder device in an open position.

In an open position, the side flaps (14,16) are inclined at an angle from the vertical axial plane of the holder device (10), (FIG. 7). The side flaps (14,16) cannot be further inclined because any such further downwards movements is resisted by the plurality of jaws (44) at the base plate (30).

A rigid plastics part (46) of the brush portion of the toothbrush (12) is introduced into the holder device (10), (FIG. 1). As the rigid plastic part (46) is pressed downwards against the plurality of jaws (44) at the base plate (30), the plurality of jaws (44) will move downwards while simultaneously the side flaps (14,16) will move towards the vertical axial plane of the holder device (10) into a close position by the cam action of the plurality of jaws (44), (FIG. 2). At this closed position the brush is encapsulated by the holder device (10). It will be appreciated that the handle portion of the toothbrush (12) will be suspended vertically from the holder device (10).

Figure 3:
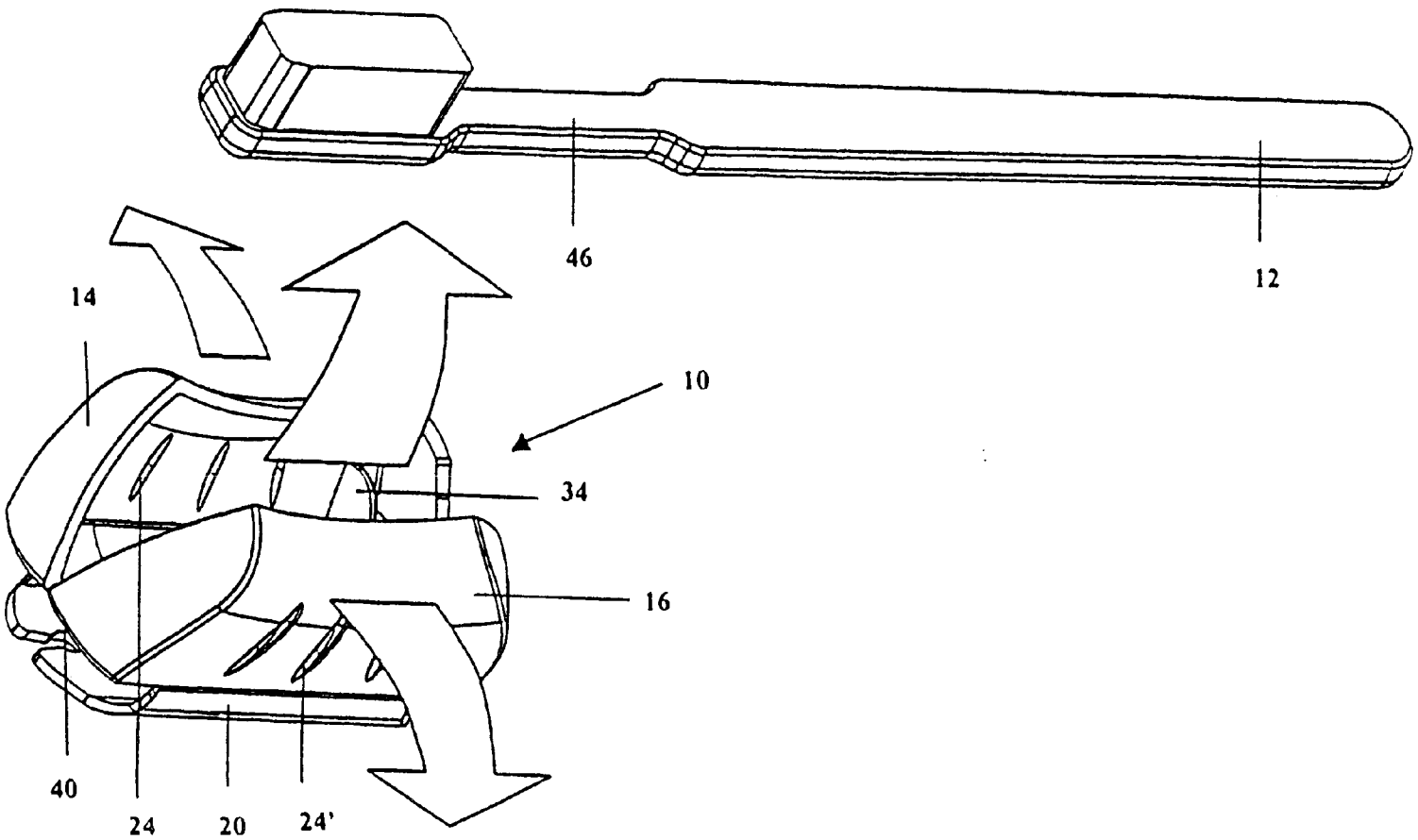
FIG. 3 illustrates a perspective view of a holder device when the brush portion of the toothbrush is removed from the holder device.
Figure 4:
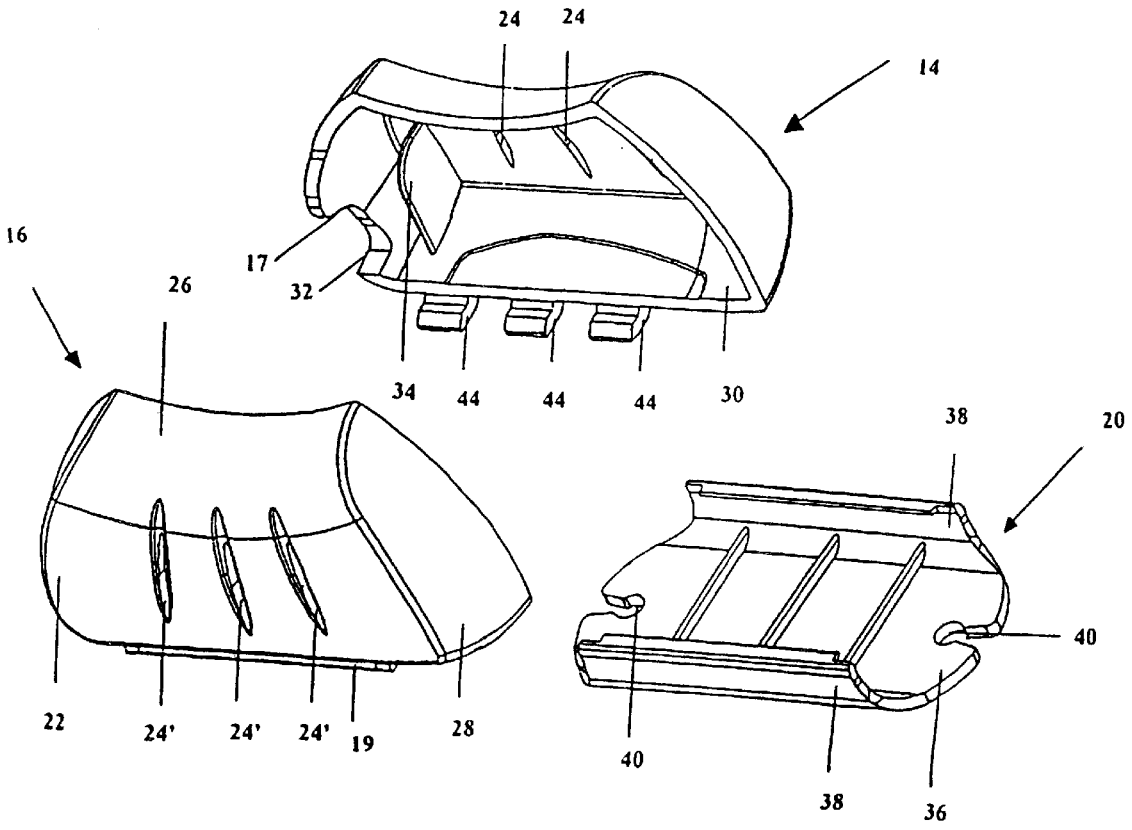
FIG. 4 is an exploded view of the side flaps and the mounting bracket.

To remove the toothbrush (12) from the holder device (10), the toothbrush (12) is remove away from the common axis of the holder device (10), (FIG. 3). As the rigid plastics part (46) of the toothbrush (12) moves away from the common axis, it pushes against the intermediate walls (34, 34') and the frictional point surface (17). The intermediate walls (34,34') will move away from the vertical axial plane of the holder device as the side flaps (14, 16) open up to a open position by a cam action of the plurality of jaws (44) and by application of upwards force of the toothbrush (12).

Thus, if The holder device (10) is opened by hand, subsequent closing and opening of the holder device (10) is effected by the placement and removal of the toothbrush (12) respectfully. The opening and closing of the side flaps (14,16) is assisted by the cam action of the side flaps (14,16) against the plurality of jaws (44) providing a snap opening and closing system.

Although, the invention has been described in relation to an embodiment for a holder device (10) for a toothbrush (10), the principles enunciated in the embodiment can be used to design a holder device (10) for other utensils such as forks and spoons, knives, scissors, and etc. in such cases, the portion of the utensils to be protected from insect pests is encapsulated in the holder device (10).

The size and shape of the holder device (10) can be varied to accommodate different types and sizes of the utensils. The holder device (10) has been described by the reference to a pair of intermediate walls (34,34'), the invention can include another pair of intermediate walls at the opposite side of the holder device (10).

In the present embodiment, the holder device (10) is made of a rigid plastics material, but it can also be replaced by any other kind of rigid material known to the art.

What is claimed is:

1. A device for holding an elongate member having a head portion and an elongated handle portion, said device comprising a mounting bracket and a housing for accommodating the head portion of the elongate member;

said housing comprising first and second housing elements each having a top wall, a bottom wall and at least one side wall connecting the top and bottom walls, said first and second housing elements being mounted on said mounting bracket to be pivotable about first and second axes, respectively, whereby said housing is movable between an open state and a closed state;

wherein when said housing is in the closed state, the bottom walls of said first and second housing elements are positioned closer to said mounting bracket than the top walls thereof and extend above said mounting bracket and transversely of the first and second axes; and said housing elements are attached to each other by a plurality of jaws provided on the bottom walls of said housing elements, thereby preventing said first and second housing elements from being displaced along the first and second axes, respectively.

2. The device of claim 1, wherein the jaws of one of said housing elements, when said housing is in the closed state, extend from a position beneath the bottom wall of said one of said housing elements to another position beneath the bottom wall of the other of said housing elements.

3. The device of claim 2, wherein the first and second axes are substantially parallel and the jaws extend substantially perpendicular to the first and second axes.

4. The device of claim 1, wherein the jaws are configured so as to resist rotation of said housing elements from a position corresponding to the closed state of said housing to another position corresponding to the open state of said housing and beyond said another position.

5. A device for holding an elongate member having a head portion and an elongated handle portion, said device comprising a mounting bracket and a housing for accommodating the head portion of the elongate member;

said housing comprising first and second housing elements each having a top wall, a bottom wall and at least one side wall connecting the top and bottom walls, said first and second housing elements being mounted on said mounting bracket to be pivotable about first and second axes, respectively, whereby said housing is movable between an open state and a closed state;

wherein when said housing is in the closed state, the bottom walls of said first and second housing elements are positioned closer to said mounting bracket than the top walls thereof and extend above said mounting bracket and transversely of the first and second axes;

each of said housing elements further comprises opposite end walls connecting the respective top, bottom, and side walls for defining an interior space of said housing element, the interior spaces of said housing elements together define an enclosed space of said housing for accommodating the head portion of the elongate member;

one of said end walls of each of said housing elements is provided with a cut-away portion, said cut-away portions of said housing elements together define an aperture of said housing for allowing the handle portion of the elongate member to extend through; and each of said housing elements further comprises an intermediate wall within the interior space thereof and between said end walls, the intermediate wall is closer to said end wall provided with said cut-away portion than to the other of said end walls.

6. A device for holding an elongate member having a head portion and an elongated handle portion, said device comprising a mounting bracket and a housing for accommodating the head portion of the elongate member;

said housing comprising first and second housing elements each having a top wall, a bottom wall and at least one side wall connecting the top and bottom walls, said first and second housing elements being mounted on said mounting bracket to be pivotable about first and second axes, respectively, whereby said housing is movable between an open state and a closed state;

wherein when said housing is in the closed state, the bottom walls of said first and second housing elements are positioned closer to said mounting bracket than the top walls thereof and extend above said mounting bracket and transversely of the first and second axes; and each of said housing elements is mounted on said mounting bracket by means of a rib provided on the respective bottom wall of said housing element.

7. The device of claim 6, wherein the rib is located at a boundary of the respective bottom wall and side wall of said housing element.

8. In combination, an elongate member having a head portion and an elongated handle portion; and a device for holding said elongate member, said device comprising:

a mounting bracket comprising a base portion and opposite first and second side portions extending upward from and longitudinally of the base portion; and a housing for accommodating the head portion of the elongate member; said housing comprising first and second housing elements each having a top wall, a bottom wall and at least one side wall connecting the top and bottom walls, said first and second housing elements being pivotably mounted on the first and second side portions of said mounting bracket, respectively, whereby said housing is movable between an open state and a closed state;

wherein the bottom walls of said housing elements together define, when said housing is in the closed state, a supporting surface spaced from the base portion of said mounting bracket for supporting the head portion of said elongate member, whereby the head portion of said elongate member is not in direct contact with the base portion of said mounting bracket.

9. The combination of claim 8, wherein each of said housing elements is mounted on said mounting bracket at an upper end of the respective side portion.

10. The combination of claim 9, wherein the upper end of the respective side portion is provided with a projection extending toward the other side portion.

11. A method of storing an elongate member having a head portion and an elongated handle portion, said method comprising the steps of:

providing a device for storing the elongate member, said device comprising a mounting bracket and a housing for accommodating the head portion of the elongate member, the housing comprising first and second housing elements each having a top wall, a bottom wall and at least one side wall connecting the top and bottom walls, the first and second housing elements being pivotably mounted on the mounting bracket;

placing the head portion of the elongate member against the bottom walls of the housing elements when the housing is in an open state with the top walls of the housing elements being pivoted away from each other; and pressing the bottom walls of the housing elements, by the head portion of the elongate member, toward the mounting bracket to forcibly rotate the housing elements until the top walls of the housing elements meet each other in a closed state of the housing.

12. The method of claim 11, further comprising the step of removing the elongate member from said device by an upwardly movement of the elongate member in a direction away from the mounting bracket, simultaneously acting, by the elongate member, upon a triggering element provided in each of the housing elements, thereby causing rotation of the housing element to move the housing from the closed state to the open state.

13. The method of claim 12, wherein the triggering elements are acted upon by the handle portion of the elongate member.

* * * * *

UNITED STATES PATENT AND TRADEMARK OFFICE

CERTIFICATE OF CORRECTION

PATENT NO. : 6,457,583 B1
DATED : October 1, 2002
INVENTOR(S) : Goo Yock Tee et al.

It is certified that error appears in the above-identified patent and that said Letters Patent is hereby corrected as shown below:

Title page,
Item [75], please correct the residence of the inventors as shown below:

"Goo Yuck Tee", -- Johor --
"Tang Peng Kee", -- Selangor --

Signed and Sealed this

Twenty-seventh Day of May, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,457,583 B1
DATED : October 1, 2002
INVENTOR(S) : Goo Yock Tee et al.

It is certified that error appears in the above-identified patent and that said Letters Patent is hereby corrected as shown below:

Title page,
Item [75], please correct the residence of the inventors as shown below:

"Goo Yock Tee", -- Johor --
"Tang Peng Kee", -- Selangor --

This certificate supersedes Certificate of Correction issued May 27, 2003.

Signed and Sealed this

Twenty-fifth Day of November, 2003

JAMES E. ROGAN
*Director of the United States Patent and Trademark Office*